United States Patent [19]

Noll

[11] Patent Number: 4,791,760

[45] Date of Patent: Dec. 20, 1988

[54] GRINDING WHEEL COOLANT DISTRIBUTOR

[75] Inventor: Burton A. Noll, Painted Post, N.Y.

[73] Assignee: Corning Glass Works, Corning, N.Y.

[21] Appl. No.: 71,294

[22] Filed: Jul. 9, 1987

[51] Int. Cl.[4] ..... B24B 55/02

[52] U.S. Cl. ..... 51/267; 51/281 R

[58] Field of Search ..... 51/266, 267, 281 R

[56] References Cited

U.S. PATENT DOCUMENTS 2,626,493 1/1953 Speicher ..... 51/267

FOREIGN PATENT DOCUMENTS 321620 6/1957 Switzerland ..... 51/267

1215064 12/1970 United Kingdom ..... 51/267

*Primary Examiner*—Roscoe V. Parker

*Attorney, Agent, or Firm*—Alfred L. Michaelsen

[57] ABSTRACT

A grinding wheel coolant distributor system is set forth utilizing a frusto-conical receptacle attached to a grinding wheel body which receives coolant from a fixed single point inlet and delivers the coolant along radially-outwardly and diverging inner sidewalls to a plurality of passages extending through the grinding wheel body to a distributor plate, which in turn, through centrifugal force distributes the coolant in a uniform thin film flow to the active abrasive face of the grinding wheel.

12 Claims, 1 Drawing Sheet

GRINDING WHEEL COOLANT DISTRIBUTOR

BACKGROUND OF THE INVENTION

This invention relates to method and apparatus for distributing a coolant to abrasive wheels, and especially diamond faced grinding wheels. In the past a center feed method of coolant introduction has been utilized in vertical rotary grinding machines, such as the Blanchard, but the methods utilized to introduce such coolant did not lend themselves to a change of wheel attitude, to small diameter grinding wheels, to the use of a minimum quantity of coolant, or to the uniformity of coolant distribution.

In order to overcome the above-noted deficiencies in the known methods of cooling grinding wheels, it is an object of the present invention to provide method and apparatus to uniformly distribute a grinding wheel coolant over the face of a grinding wheel in such a manner so as to permit a single coolant feed point, while facilitating the use of an unrestrained point of contact between the wheel and the work base.

SUMMARY OF THE INVENTION

In its simplest form, the present invention sets forth a new concept in providing cooling for abrasive wheels utilizing a single fixed coolant feed point for all orientations of the abrasive wheel. The coolant is introduced into a rotation cone-shaped receptacle attached to an abrasive grinding wheel, and through centrifugal forces, is directed through a plurality of openings to a distributor plate which permits the coolant to be uniformly delivered to the inside rim of the grinding wheel, irrespective of the orientation of the wheel.

By so uniformly distributing the coolant to the surface of the grinding wheel, a significant reduction of coolant required to cool the abrasive grinding wheel is obtained. Further, with respect to diamond faced wheels, a significant improvement is obtained in the cooling of the diamond surface so as to enhance the diamond life and product finish.

DESCRIPTION OF THE PREFERRED EMBODIMENTS

Figure 1:
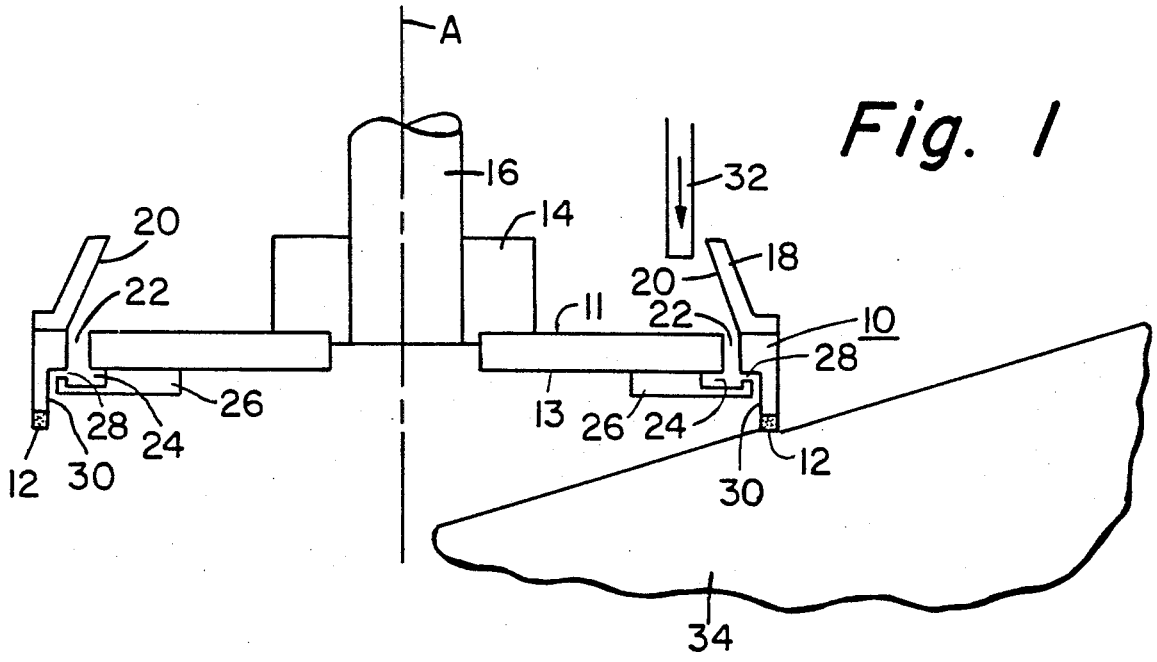
FIG. 1 is a schematic illustration of a grinding wheel coolant distributor embodying the present invention.

A grinding wheel 10 having an active abrasive face 12 is mounted by means of a mounting hub 14 to a shaft 16 rotatable about an axis A. A frusto-conical receptacle 18, which is concentric with axis A, is secured to a rear surface 11 of the grinding wheel 10. The frusto-conical receptacle 18 has inner sidewalls 20 which are tapered or radially-outwardly diverging toward the rear surface 11. A plurality of passages 22 extend through the grinding wheel 10, adjacent the sidewalls 20, and communicate with an annular groove 24 formed in a ring-like annular distributor plate 26 secured to a front face 13 of the grinding wheel 10. A small gap 28 communicates between the annular groove 24 and a radially-outward portion of the front face 13 adjacent an inside rim 30 of the grinding wheel 10.

As shown in FIG. 1, a single fixed coolant feed point inlet 32 is positioned adjacent the tapered inner sidewalls 20 of the frusto-conical receptacle 18. A suitable coolant, such as water, is introduced into the rotating frusto-conical receptacle 18 by means of inlet 32. The coolant will be accelerated to approximately cone velocity, with the fluid flowing along the walls 20 toward the passage 22. Centrifugal forces deliver the coolant through the plurality of passages 22 to the continuous groove 24 formed in the round distributor plate 26, with such forces equalizing the flow of the coolant within such groove. The small gap 28 between the distributor plate 26 and the rear surface 13 of the grinding wheel 10, permits the coolant to be uniformly delivered to the inside rim 30 of the grinding wheel, where again the centrifugal forces and resultant hydraulic equalization forces deliver the coolant in a uniform thin film flow to the active abrasive face 12 of the grinding wheel 10.

In view of the fact that the resultant hydraulic forces of the coolant are in a range of about 5 to 10 psi for wheel speeds utilized for normal grinding of most materials, the attitude of the rotating system is of little consequence in obtaining the result of uniform coolant distribution. Although the axis A in FIG. 1 is shown as being vertical, with a workpiece 34 shown angled across the active abrasive surface 12, the apparatus of FIG. 1 could be operational in virtually any position of the axis A, simply by adjusting the inlet pressure of the coolant delivered by inlet 32 so that it contacted the inside walls 20 of the receptacle 18. Without materially adjusting the inlet pressure, however, the device disclosed in FIG. 1 would be operational in any position of axis A from about 45 !degrees counterclockwise from that shown, to about 135 degrees clockwise from that shown. For the remaining positions of axis A, the embodiment shown in FIG. 2 is preferred.

Figure 2:
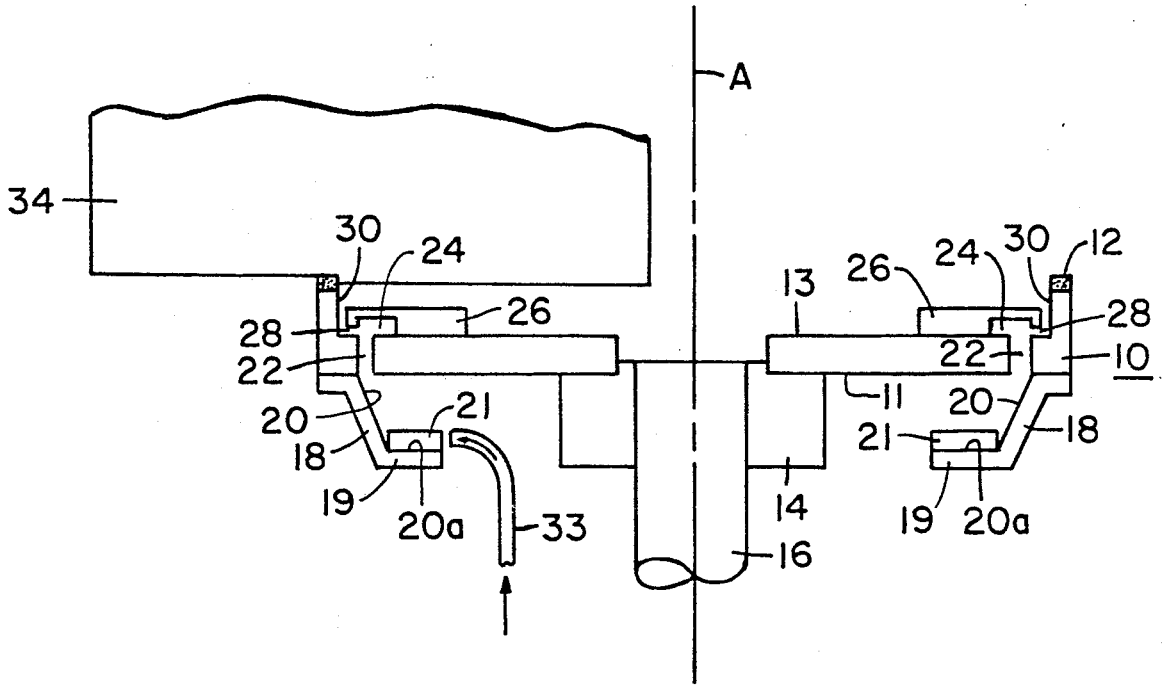
FIG. 2 is a schematic illustration of a further embodiment of the present invention.

As shown in FIG. 2, the axis A is also vertically extending, however the workpiece is shown positioned above the abrasive surface 12 of the grinding wheel 10. Also, the frusto-conical receptacle 18 is provided with a radially inwardly directed flange 19, preferably lying within a plane extending perpendicular to the axis A, and having a plurality of accelerator vanes 21 secured to its inner surface 20a, which is contiguous with surface 20. An inlet 33 directs the coolant toward the accelerator vanes 21 so that the fluid immediately flows along surface **20*a* toward surface 20 and then through passages 22, groove 24, and gap 28, to the active abrasive face 12 of the grinding wheel 10, similar to that described with regard to FIG. 1. Again, centrifugal forces and the resultant hydraulic equalization forces deliver the coolant in a uniform thin film flow to the active abrasive face 12 of the grinding wheel 10**. Accordingly, a significant reduction in the amount of coolant required is obtained with the present invention.

Although I have described the now preferred embodiments of my invention, it will be apparent to those skilled in the art that various changes and modifications may be made thereto without departing from the spirit and scope of the invention as set forth in the following claims.

I claim:

1. A method of distributing a coolant to the active abrasive face of a grinding wheel which comprises:

delivering a coolant from a single fixed inlet to a frusto-conical surface on one side of the grinding wheel, applying centrifugal force to said coolant to flow the same radially-outwardly along said frusto-conical surface, flowing said coolant from said frusto-conical surface through passages in said grinding wheel to an annular groove formed on an opposite side of the grinding wheel, and utilizing centrifugal force to distribute said coolant in a uniform thin film flow from said groove to said active abrasive face of the grinding wheel.

2. A method of distributing a coolant to the active abrasive face of a grinding wheel as defined in claim 1 including the step of flowing said coolant through a gap extending between said annular groove and a rim portion of said grinding wheel.

3. A method of distributing a coolant to the active abrasive face of a grinding wheel as defined in claim 1 including the step of accelerating the flow of the coolant from the single fixed inlet to the frusto-conical surface by means of centrifugal force in order to overcome inherent gravitational forces.

4. A method of distributing a coolant to the active abrasive face of a grinding wheel as defined in claim 1 including the step of continuously flowing said coolant under the influence of centrifugal force radially-outwardly along said frusto-conical surface and through said passages in the grinding wheel to said annular groove.

5. A method of distributing a coolant to the active abrasive face of a grinding wheel as defined in claim 1, wherein the centrifugal force applied to said coolant is obtained through the rotation of said grinding wheel.

6. A grinding wheel coolant distributor comprising:

a grinding wheel body having a front face, a rear face, and an annular rim provided with an active abrasive face;

means of rotating said grinding wheel body about a central axis;

frusto-conical means secured to one surface of said grinding wheel;

distributor means secured to an opposite face of said grinding wheel with an annular groove therebetween;

passages extending through said grinding wheel and communicating with said frusto-conical means and said distributor means;

a flow gap extending between said distributor means and the rim portion of said grinding wheel; and means for delivering coolant to said frusto-conical means for flow therealong and through said passages to said groove for distribution through said gap to said active abrasive face.

7. A grinding wheel coolant distributor as defined in claim 6 wherein said frusto-conical means includes a frusto-conical receptacle secured to said rear face of said grinding wheel body, said frusto-conical receptacle having inner sidewalls which are radially-outwardly diverging toward said rear face, and said radially-outwardly diverging inner sidewalls terminating in direct communication with said passages extending through said grinding wheel.

8. A grinding wheel coolant distributor as defined in claim 6 wherein said distributor means includes a ring-like annular distributor plate secured to the front face of said grinding wheel body, and said annular groove communicates with said passages extending through said grinding wheel.

9. A grinding wheel coolant distributor as defined in claim 8 wherein said flow gap is formed between said ring-like annular distributor plate and a radially outward portion of said front face of the grinding wheel body, such that flow of coolant from said annular groove through said flow gap provides a uniform thin film flow along said rim portion to the active abrasive face of said grinding wheel.

10. A grinding wheel coolant distributor as defined in claim 6 wherein said frusto-conical means includes a flange extending substantially perpendicular to said central axis, a plurality of accelerator vanes positioned about an inner wall of said flange, and said means for delivering coolant to said frusto-conical means including a single fixed coolant feed inlet for directing a coolant to said accelerator veins.

11. A grinding wheel coolant distributor as defined in claim 10 wherein said frusto-conical means includes tapered radially-outwardly diverging inner sidewalls which terminate adjacent said passages such that coolant delivered by said inlet is distributed by said accelerator vanes to said outwardly diverging inner sidewalls and through said passages by means of centrifugal force about said central axis.

12. An improved grinding wheel cooling system comprising:

a grinding wheel body having a rear surface, a front face, and a rim portion terminating in an active abrasive face;

means for rotating said grinding wheel about a central axis;

a plurality of passages extending through said grinding wheel body between said rear face and said front face;

a distributor plate mounted on said front face and having an annular groove directly communicating with said plurality of passages, and an annular gap communicating between said groove and the rim portion of said grinding wheel;

a fixed single point coolant feed inlet means for delivering coolant to said grinding wheel body; and frusto-conical receptacle means mounted on said rear face for receiving coolant from said inlet means and delivering such coolant through said passages and to said groove of said distributor plate for distribution through said gap to the active abrasive face.

* * * * *